United States Patent [19]

Howard

[11] 4,056,957

[45] Nov. 8, 1977

[54] DRIVE ARRANGEMENT FOR THE ROLLS OF A ROLLING MILL

[75] Inventor: David Robert Howard, Sheffield, England

[73] Assignee: Davy-Loewy Limited, England

[21] Appl. No.: 793,331

[22] Filed: May 3, 1977

Related U.S. Application Data

[63] Continuation of Ser. No. 681,090, April 28, 1976, abandoned.

[51] Int. Cl.[2] ..... B21B 37/00; B21B 35/00

[52] U.S. Cl. ..... 72/19; 72/249

[58] Field of Search ..... 72/19, 28, 249, 21

[56] References Cited

U.S. PATENT DOCUMENTS

| | | | |
|---|---|---|---|
| 3,124,020 | 3/1964 | Polakowski | 72/21 |
| 3,298,212 | 1/1967 | Cook | 72/249 X |
| 3,353,384 | 11/1967 | Perkain et al. | 72/19 |

*Primary Examiner*—Milton S. Mehr

*Attorney, Agent, or Firm*—Daniel Patch; Suzanne Kikel

[57] ABSTRACT

In a rolling mill it is desirable that the torques delivered by the two driven rolls should be the same or at least there should be some predetermined torque differential between them. The torque transmitted by each of the driven rolls is measured and a measure of the difference between the torques is obtained. Said measure is then used to adjust the angular length of that part of the periphery of at least one roll where it is in contact with the workpiece being rolled in the sense to bring about the required torque distribution.

The angular length may be adjusted by varying the angle of approach or exit of the workpiece relative to the mill rolls.

5 Claims, 3 Drawing Figures

DRIVE ARRANGEMENT FOR THE ROLLS OF A ROLLING MILL

Figure 2:
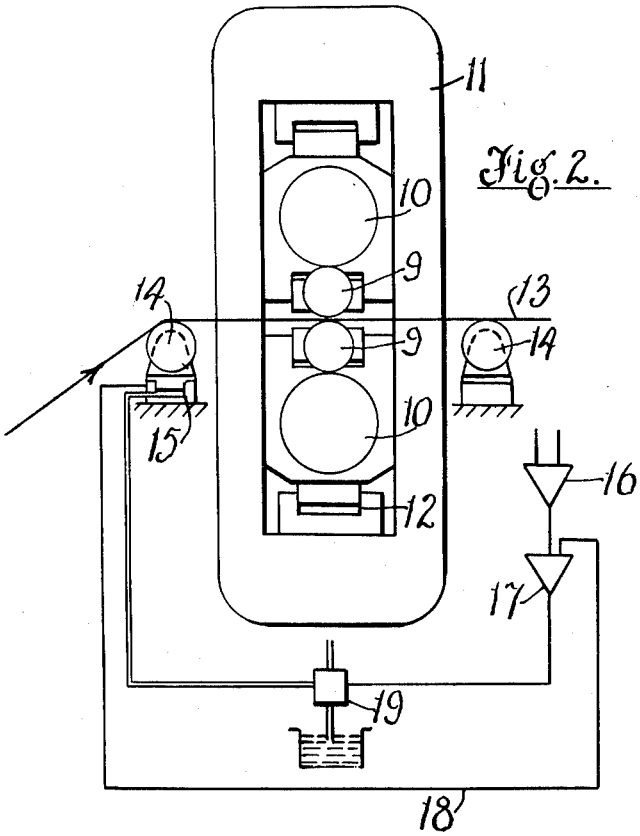

This is a continuation of application Ser. No. 681,090, filed April 28, 1976, abandoned.

This invention relates to a method of, and apparatus for, controlling the distribution of torque between the driven rolls of a rolling mill.

It is conventional practice to drive the work rolls of a two-high or four-high rolling mill by means of an electric motor in driving engagement with one of a pair of meshing pinions in a pinion box and with the pinions connected to the two rolls by separate drive spindles. The most important disadvantages with this arrangement is that if there is any significant difference between the diameters of the two driven rolls then there will be a difference between the torques delivered by the two spindles. In extreme cases such as may arise when the friction between the rolls and strip material being rolled is high, as in temper rolling, and/or when very long workpieces are being rolled, the difference between the torques delivered by the two spindles can assume very high values. Unequal torque being transmitted to the work rolls of a mill may cause scratching of the rolled surface of the workpiece and furthermore the physical dimensions of the spindles and pinion box have to be such as to be able to accommodate the maximum torque although this may be considerably in excess of the normal torque experienced during rolling.

Usually it is desirable that there should not be any difference between the torques delivered by the two rolls but in certain circumstances it may be desirable for a fixed and known torque differential to exist between them According to a first aspect of the present invention, in a method of controlling the distribution of torque between the driven rolls of a rolling mill when the mill is used to roll a workpiece, the torque transmitted by each of the driven rolls is measured, a measure of the difference between the torques is obtained and said measure is employed to adjust the angular length of that part of the periphery of at least one roll where it is in contact with the workpiece in the sense to bring about the required torque distribution.

The angular length of that part of the periphery of each roll where it is in contact with the workpiece can be adjusted by varying the angle of approach of the incoming material to the roll gap or by varying the angle at which the material leaves the roll gap. To vary the angle of approach of the workpiece to the roll gap the vertical position of a deflector roll on the ingoing side of the mill may be adjusted; the vertical position of the roll stack in relation to fixed deflector rolls at the ingoing and outgoing side of the mill can be adjusted; and furthermore the axis of one of the work rolls can be displaced relative to the other work roll across the vertical centre line of the mill. To vary the angle at which the material leaves the roll gap a deflector roll positioned at the outgoing side of the mill and in contact with the underside of the workpiece is raised and lowered.

According to a second aspect of the present invention control apparatus for controlling the distribution of torque between the driven rolls of a rolling mill comprises means associated with each driven roll for producing electrical signals representative of the torque transmitted by said roll, means for comparing said signals to produce a difference signal and means responsive to said difference signal for adjusting the angular length of that part of the periphery of at least one roll where it is in contact with a workpiece being rolled.

Figure 1:
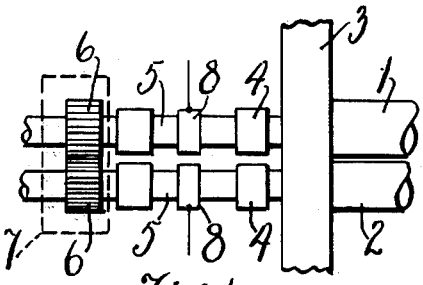
Figure 3:
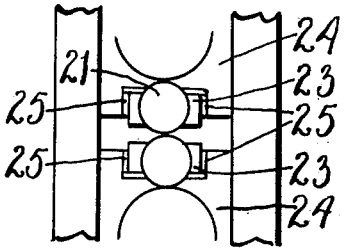

Means for measuring the torque transmitted by the rolls may take the form of electric resistance strain gauges bonded to the spindles driving the rolls. The output signals from these gauges may be transmitted either by the use of slip rings mounted on the spindles or by telemetry. As an alternative, to measure the torque transmitted by a roll, load cells may be installed between the lateral sides of a bearing chock at one end of the roll and adjacent supports and in this case the electrical signals are taken from the stationary load cells. In order that the invention may be more readily understood, it will now be described, by way of example only, with reference to the accompanying drawing in which:

FIG. 1 is a diagrammatic view of the drive spindles and the work rolls of a rolling mill, FIG. 2 is a diagrammatic side elevation of a rolling mill having means for controlling the distribution of torque applied to the mill rolls, and FIG. 3 is a diagrammatic view of the work roll chocks of a rolling mill showing an alternative form of means for determining the torque on the rolls of the mill.

Referring to FIG. 1, the work rolls 1, 2 of a rolling mill are shown mounted at one end in a mill housing 3. The ends of the rolls are connected through couplings 4 one to each of a pair of drive spindles 5. The spindles are connected to a pair of meshing pinions 6 in a pinion box 7. On each of the spindles 5 there is a device 8 for producing an electrical signal representative of the torque transmitted by the spindle. The device 8 may conveniently take the form of electric resistance strain gauges bonded to the spindles. A torque detector mounted upon the driving spindle of a roll of a rolling mill is disclosed in British Pat. No. 993968. Each of the devices 8 may take the form of the torque detector described in the above-mentioned patent.

Referring now to FIG. 2, a rolling mill has a pair of work rolls 9 and a pair of back-up-rolls 10. The rolls are supported at their ends in bearing chocks which are mounted in a pair of mill housings one of which is indicated by reference numeral 11. A position regulated hydraulic ram 12 is located in each of the mill housings between the housing and the chock of the lower roll to adjust the gap between the work rolls.

A metal strip passing through the mill to be rolled therein is indicated by reference numeral 13 and on both the ingoing and the outgoing side of the mill there is a vertically displaceable deflector roll 14. The roll on the ingoing side of the mill is displaceable vertically by a hydraulically operated position regulated capsule 15.

The work rolls 9 are each driven by drive spindles having torque detectors associated therewith as described in connection with FIG. 1. The electrical signals from the torque detectors are applied to a differencing amplifier 16 which produces an electrical signal representative of the difference in torque transmitted by the two work rolls. This difference signal is applied to a second amplifier 17 which also receives a signal from the capsule 15 by way of line 18. The output from the amplifier 17 controls a servo valve 19 which controls the flow of hydraulic fluid under pressure to the capsule 15. The two electrical signals representative of the torque transmitted by the two work rolls are compared in amplifier 16 and if the difference signal is not to the required value the servo valve 19 is controlled to supply fluid to the capsule 15 to either raise or lower the deflector roll 14 so that the angle of approach of the ingoing material to the roll gap is varied. If for example the torque transmitted by the upper roll is too high as compared with the torque transmitted by the lower work roll then the deflector roll 14 on the ingoing side is lowered so that the angular length of the material in engagement with the upper work roll is reduced and the angular length of the material in contact with the lower work roll is increased. In a similar way by lowering the deflector roll 14 on the ingoing side of the mill the angular length of the material engaging the periphery of the lower work roll is increased and that engaging the periphery of the upper work roll is decreased.

A similar variation of the angle of approach of the incoming material to the roll gap can be obtained by adjusting the vertical position of the roll stack in relation to the fixed deflector rolls 14. If unequal division of the torques between the two work rolls is required a biasing reference voltage may be applied to the amplifier 17.

An alternative way of varying the angular length of the material in contact with the two work rolls is to vary the vertical position of the deflector roll 14 on the outgoing side of the mill. i.e. to vary the angle at which the rolled material leaves the roll gap.

In the arrangement shown in FIGS. 1 and 2 the work rolls have been driven from a single electric drive motor by employing a pinion box but the invention is also applicable to rolling mills in which the driven rolls are driven by separate electric motors.

FIG. 3 shows an alternative way in which a signal representative of the torque on each work roll can be obtained. The work rolls 21, 22 are mounted at their ends in bearing chocks 23 which are nested in recesses in the back-up bearing chocks 24. Between each lateral side of each work roll chock and the adjacent wall of the back-up chock there is located a load cell 25. When there is a finite difference between the torques transmitted to the two work rolls then there is a tendency for the chocks to be displaced laterally. The reaction forces required to restrain the chocks are proportional to the difference between the torques and so a measure of these forces gives a measure of the torque difference between the two rolls. This difference may therefore be sensed by load cells 25.

I claim:

1. A rolling mill comprising: a pair of spaced apart housings each defining a window, a pair of dissimilar diameter work rolls each rotatably supported at its ends in bearing chock assemblies mounted in said windows, a driving system including drive means for the rolls including a pair of spindles connected one to each roll and gear means interconnecting the spindles having differential torques locked into the driving system caused by said dissimilar diameters of said work rolls, each roll having means associated therewith for producing an electrical signal representative of the torque transmitted by the roll, means arranged to receive and compare said signals and to produce a differential signal, and means responsive to said differential signal for adjusting the angular length of that part of the periphery of at least one roll where it is in contact with the workpiece being rolled in order to adjust the torque transmitted by that roll in the sense to reduce said differential signal.

2. A rolling mill as claimed in claim 1 in which said means for producing a signal representative of the torque transmitted by the rolls is a strain gauge in each roll acting on the drive spindle of the rolls.

3. A rolling mill as claimed in claim 1 in which said means for producing a signal representative of the difference in torque transmitted by the rolls is for each roll a pair of load cells positioned between opposite lateral sides of a bearing chock at one end of the roll and a pair of adjacent support surfaces.

4. A rolling mill as claimed in claim 3 in which said support surfaces are on a bearing chock for a back-up roll in arrangement with a said driven roll.

5. A rolling mill as claimed in claim 1 wherein said means for adjusting the angular length of the periphery of at least one roll where it is in contact with a workpiece comprises a deflector roll displaceable vertically and positioned at either the ingoing or outgoing side of the mill.

* * * * *